US011925277B2

(12) United States Patent
Gross

(10) Patent No.: US 11,925,277 B2
(45) Date of Patent: Mar. 12, 2024

(54) COSMETIC SPONGE HOLDING ASSEMBLY

(71) Applicant: Yehuda Gross, Newark, NJ (US)

(72) Inventor: Yehuda Gross, Newark, NJ (US)

( * ) Notice: Subject to any disclaimer, the term of this patent is extended or adjusted under 35 U.S.C. 154(b) by 120 days.

(21) Appl. No.: 17/710,063

(22) Filed: Mar. 31, 2022

(65) Prior Publication Data

US 2023/0309715 A1 Oct. 5, 2023

(51) Int. Cl.

| | |
|---|---|
| ***A47F 5/04*** | (2006.01) |
| ***A45D 40/26*** | (2006.01) |
| ***A47F 7/02*** | (2006.01) |
| *A45D 44/00* | (2006.01) |
| *A47L 13/51* | (2006.01) |
| *D06F 59/04* | (2006.01) |

(52) U.S. Cl.

CPC ..... *A47F 5/04* (2013.01); *A45D 40/26* (2013.01); *A45D 44/00* (2013.01); *A45D 2200/1009* (2013.01); *A47L 13/51* (2013.01); *D06F 59/04* (2013.01)

(58) Field of Classification Search

CPC ..... A47F 5/04; A45D 44/00; A45D 40/26; A45D 2200/1009; A47L 13/51; D06F 59/04

See application file for complete search history.

(56) References Cited

U.S. PATENT DOCUMENTS

| | | | | |
|---|---|---|---|---|
| 1,747,951 | A * | 2/1930 | Reichert | A47F 7/06 211/33 |
| 2,316,878 | A * | 4/1943 | Mandalou | B43M 11/04 131/245 |
| 3,409,142 | A * | 11/1968 | Mechaneck | F26B 9/00 223/78 |
| 3,477,622 | A * | 11/1969 | Appelt | D06F 59/04 223/78 |
| D276,962 | S | 1/1985 | Moore | |
| 7,374,136 | B1 * | 5/2008 | Perea | A47F 5/04 248/121 |
| 9,125,487 | B1 * | 9/2015 | Gonzalez Ruiz | A47B 61/04 |
| 9,220,391 | B1 | 12/2015 | Henninger | |
| 9,512,556 | B1 | 12/2016 | Kazravan | |
| 9,897,378 | B2 | 2/2018 | Palmer | |
| D830,719 | S | 10/2018 | Palumbo | |
| D850,828 | S | 6/2019 | Tingvall | |
| 10,849,448 | B1 | 12/2020 | Bland | |
| 2010/0300900 | A1 | 12/2010 | Quan | |
| 2021/0076806 | A1 | 3/2021 | Taylor | |

FOREIGN PATENT DOCUMENTS

| | | | | |
|---|---|---|---|---|
| CA | 2667871 | A1 * | 12/2010 | A45C 11/16 |

* cited by examiner

*Primary Examiner* — Tan Le

(57) ABSTRACT

A cosmetic sponge holding assembly for holding cosmetic sponges includes a base that is positionable on a horizontal support surface. A plurality of support members is each coupled to and extends upwardly from the base. A plurality of holding members is provided and the plurality of holding members includes a plurality of sets of holding members. Each of the sets of holding members is coupled to a respective one of the support members. Furthermore, each of sets of holding members on each of the support members angles away from the respective support member that each of the sets of holding members defines a holder for holding a cosmetic sponge.

6 Claims, 4 Drawing Sheets

COSMETIC SPONGE HOLDING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to cosmetic sponge devices and more particularly pertains to a new cosmetic sponge device for holding cosmetic sponges for drying. The device includes a base and a plurality of support members that each extends upwardly from the base. The device includes a plurality of sets of holding members and each of the sets of holding members radiates outwardly from a respective support member to define a plurality of holders. Each of the holders can hold a cosmetic sponge to facilitate the cosmetic sponge to dry.

(2) Description of Related Art Including Information Disclosed Under 37 CFR 1.97 and 1.98

The prior art relates to cosmetic sponge devices including a box that has a foraminous compartment for holding a sponge for drying. The prior art discloses a support stand in the shape of a human hand for supporting a glove for drying the glove. The prior art discloses a sponge container for enclosing a cosmetic sponge for drying the cosmetic sponge. The prior art discloses a jewelry tree that includes a support member and a plurality of holding members that angle away from the support member for holding jewelry. The prior art discloses a plant stand that includes a trunk and a plurality of branches extending away from the trunk for holding plant pots.

BRIEF SUMMARY OF THE INVENTION

An embodiment of the disclosure meets the needs presented above by generally comprising a base that is positionable on a horizontal support surface. A plurality of support members is each coupled to and extends upwardly from the base. A plurality of holding members is provided and the plurality of holding members includes a plurality of sets of holding members. Each of the sets of holding members is coupled to a respective one of the support members. Furthermore, each of sets of holding members on each of the support members angles away from the respective support member that each of the sets of holding members defines a holder for holding a cosmetic sponge.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
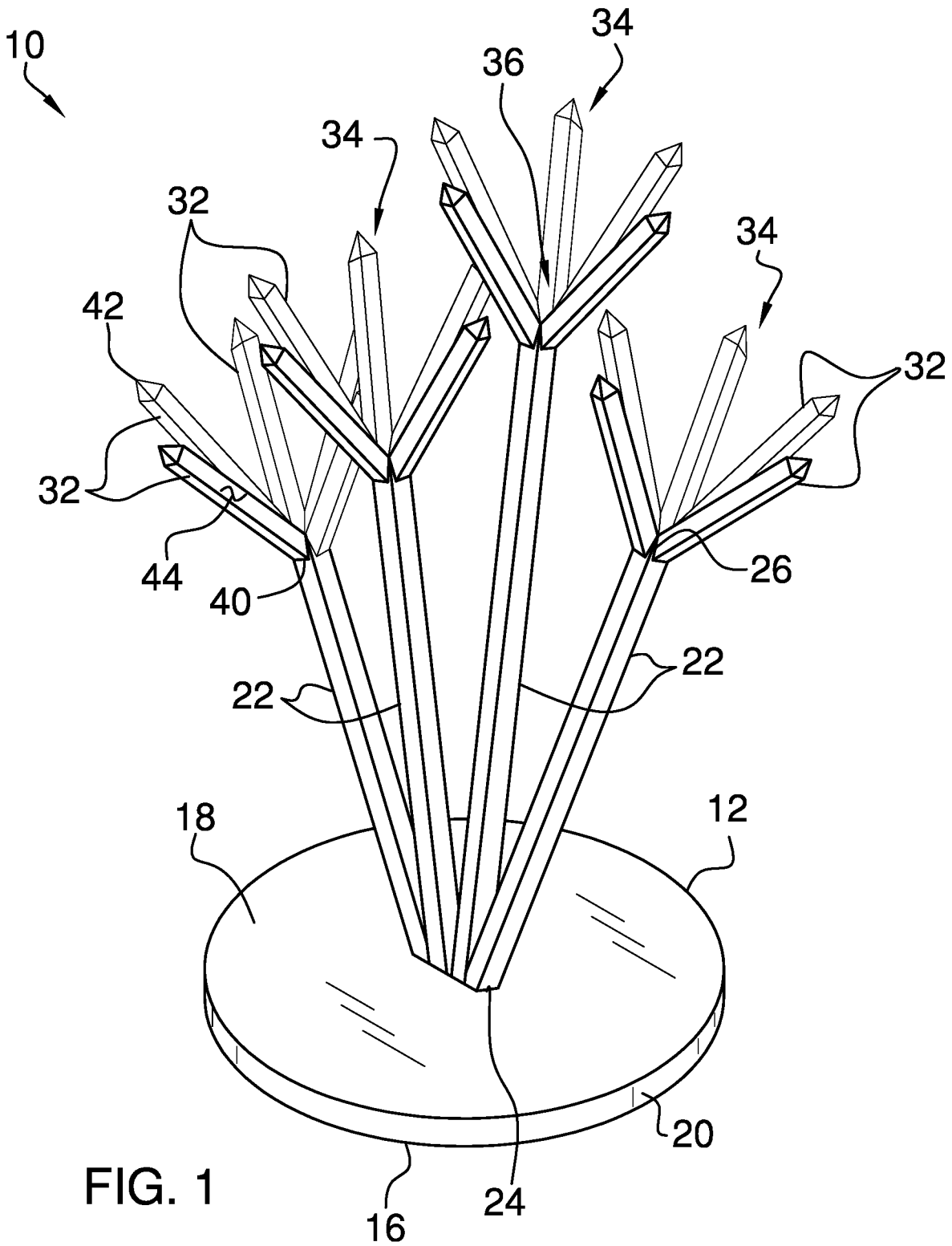
FIG. 1 is a top perspective view of a cosmetic sponge holding assembly according to an embodiment of the disclosure.
Figure 2:
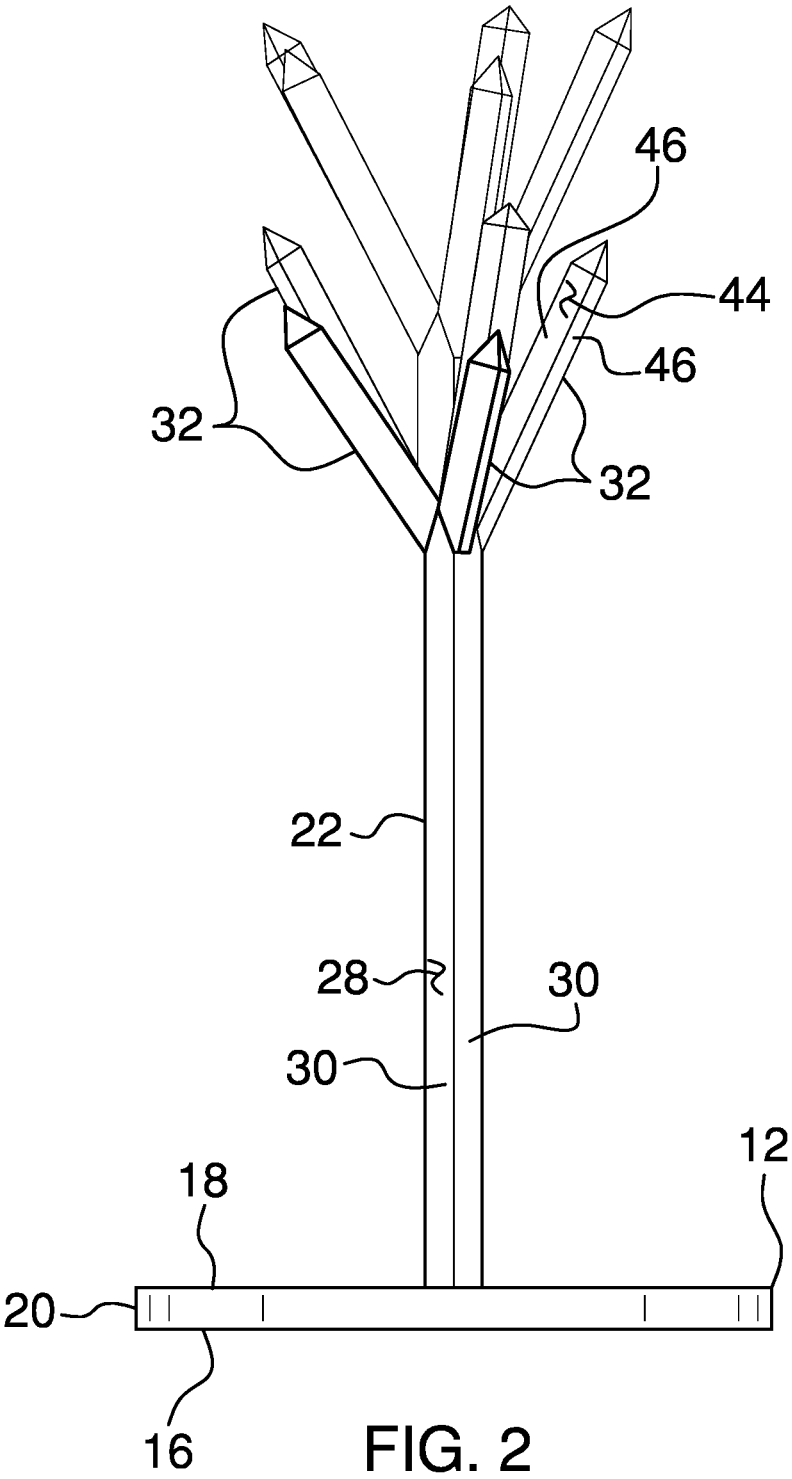
FIG. 2 is a left side view of an embodiment of the disclosure.
Figure 3:
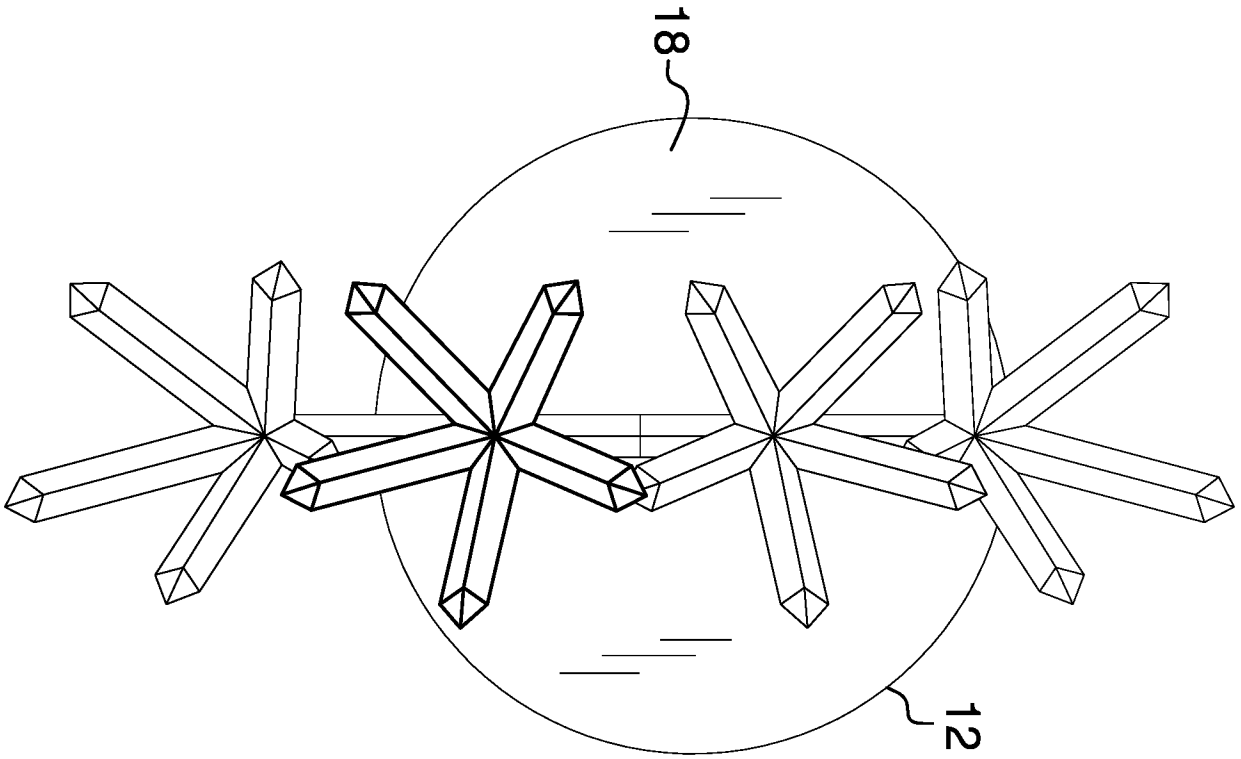
FIG. 3 is a top view of an embodiment of the disclosure.
Figure 4:
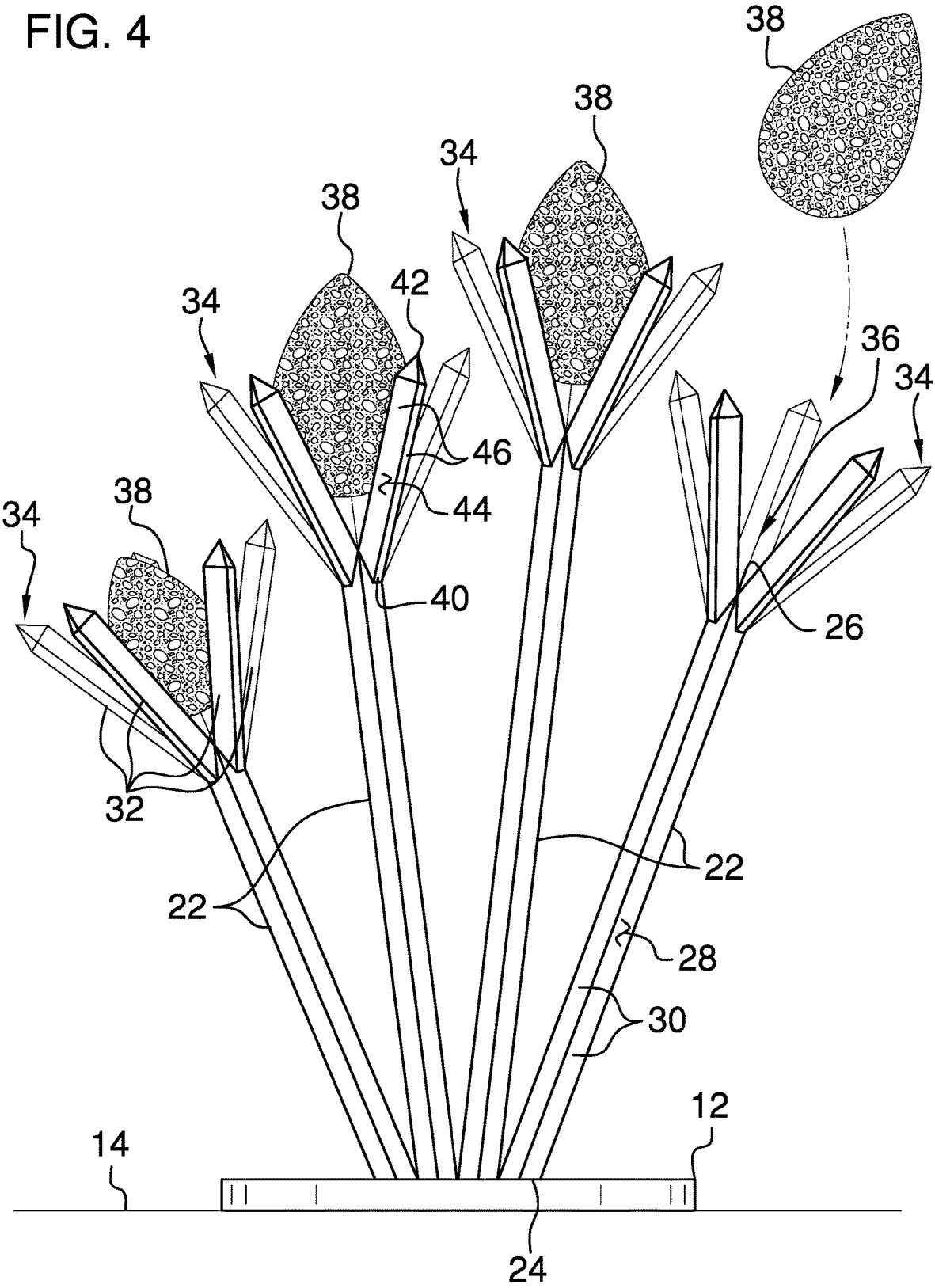
FIG. 4 is a perspective in-use view of an embodiment of the disclosure.

With reference now to the drawings, and in particular to FIGS. 1 through 4 thereof, a new cosmetic sponge device embodying the principles and concepts of an embodiment of the disclosure and generally designated by the reference numeral 10 will be described.

As best illustrated in FIGS. 1 through 4, the cosmetic sponge holding assembly generally comprises a base 12 is positionable on a horizontal support surface 14. The horizontal support surface 14 may be a table top, a vanity or other horizontal support surface 14 that might be employed for the application of cosmetic makeup. The base 12 has a bottom side 16 and a top side 18, and the bottom side 16 rests on the horizontal support surface 14. Additionally, the base 12 may have a continuously arcuate perimeter edge 20 such that the base 12 has a disk shape which as a diameter ranging between approximately 4.0 inches and 6.0 inches.

A plurality of support members 22 is provided and each of the support members 22 is coupled to and extends upwardly from the base 12. Each of the support members 22 has a bottom end 24, a top end 26 and an outer surface 28 extending between the bottom end 24 and the top end 26. The outer surface 28 has a plurality of intersecting sides 30 such that each of the support members 22 has a cuboid shape. In this way each of support members 22 has the ornamental appearance of a mineralized crystal.

The bottom end 24 of each of the support members 22 is coupled to the top side 18 of the base 12. The bottom end 24 of each of the support members 22 is aligned with a common axis extending laterally across the top side 18 of the base 12. The plurality of support members 22 angles away from a center point of the top side 18 of the base 12. The plurality of support members 22 may have a length ranging between approximately 8.0 inches and 10.0 inches. Additionally, each of the support members 22 has a unique height with respect to each other.

A plurality of holding members 32 is provided and the plurality of holding members 32 includes a plurality of sets of holding members 34. Each of the sets of holding members 34 is coupled to a respective one of the support members 22. Each of sets of holding members 34 on each of the support members 22 angles away from the respective support member 22 that each of the sets of holding members 34 defines a holder 36 for holding a cosmetic sponge 38. Each of the holding members 32 has a lower end 40, an upper end 42 and an outside surface 44 extending between the lower end 40 and the upper end 42. Moreover, the outside surface 44 of each of the holding members 32 has a plurality of intersecting sides 46 such that each of the holding members 32 has a cuboid shape. In this way each of the holding members 32 has the ornamental appearance of a mineralized crystal.

The lower end 40 of each of the holding members 32 is coupled to a respective one of the intersecting sides 30 of the outer surface 28 of the respective support member 22 at a point located adjacent to the top end 26 of the respective holding member 32. In this way each of the sets of the holding members 32 radiates outwardly from the top end 26 of the respective support member 22. Furthermore, each of the intersecting sides 46 of the outside surface 44 of each of the holding members 32 tapers to a point at the upper end 42 of the holding members 32. Each of the holding members 32 may have a length ranging between approximately 2.0 inches and 4.0 inches.

In use, the base 12 is positioned in a location that is typically employed for the application of cosmetic makeup. In this way cosmetic sponges 38 can each be positioned in the holder 36 defined by the plurality of holding members 32 on a respective support member 22. In this way the cosmetic sponges 38 can be stored by drying in a manner that facilitates maximum exposure to air for sufficiently drying the cosmetic sponges 38. Additionally, the ornamental appearance of the support members 22 and the holding members 32 creates a motif that correlates with the concept of beauty and cosmetology.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A cosmetic sponge holding assembly for holding cosmetic sponges for drying the cosmetic sponges, said assembly comprising:

a base being positionable on a horizontal support surface;

a plurality of support members, each of said support members being coupled to and extending upwardly from said base;

a plurality of holding members, said plurality of holding members including a plurality of sets of holding members, each of said sets of holding members being coupled to a respective one of said support members, each of sets of holding members on each of said support members angling away from said respective support member that each of said sets of holding members defines a holder for holding a cosmetic sponge;

wherein said base has a bottom side and a top side, said bottom side resting on the horizontal support surface;

wherein each of said support members has a bottom end, a top end and an outer surface extending between said bottom end and said top end, said outer surface having a plurality of intersecting sides such that each of said supports has a cuboid shape wherein each of support members is configured to have the ornamental appearance of a mineralized crystal;

wherein said bottom end of each of said support members is coupled to said top side of said base; and wherein each of said holding members has a lower end, an upper end and an outside surface extending between said lower end and said upper end, said outside surface of each of said holding members having a plurality of intersecting sides such that each of said holding members has a cuboid shape wherein each of said holding members is configured to have the ornamental appearance of a mineralized crystal, said lower end of each of said holding members being coupled to a respective one of said intersecting sides of said outer surface of said respective support member.

2. The assembly according to claim 1, wherein said bottom end of each of said support members is aligned with a common axis extending laterally across said top side of said base.

3. The assembly according to claim 1, wherein said plurality of support members angles away from a center point of said top side of said base, each of said support members having a unique height with respect to each other.

4. The assembly according to claim 1, wherein each of said holding members is positioned at a point located adjacent to said top end of said respective holding member such that each of said sets of said holding members radiates outwardly from said top end of said respective support member.

5. The assembly according to claim 1, wherein each of said intersecting sides of said outside surface of each of said holding members tapers to a point at said upper end of said holding members.

6. A cosmetic sponge holding assembly for holding cosmetic sponges for drying the cosmetic sponges, said assembly comprising:

a base being positionable on a horizontal support surface, said base having a bottom side and a top side, said bottom side resting on the horizontal support surface;

a plurality of support members, each of said support members being coupled to and extending upwardly from said base, each of said support members having a bottom end, an top end and an outer surface extending between said bottom end and said top end, said outer surface having a plurality of intersecting sides such that each of said supports has a cuboid shape wherein each of support members is configured to have the ornamental appearance of a mineralized crystal, said bottom end of each of said support members being coupled to said top side of said base, said bottom end of each of said support members being aligned with a common axis extending laterally across said top side of said base, said plurality of support members angling away from a center point of said top side of said base, each of said support members having a unique height with respect to each other; and a plurality of holding members, said plurality of holding members including a plurality of sets of holding members, each of said sets of holding members being coupled to a respective one of said support members, each of sets of holding members on each of said support members angling away from said respective support member that each of said sets of holding members defines a holder for holding a cosmetic sponge, each of said holding members having a lower end, an upper end and an outside surface extending between said lower end and said upper end, said outside surface of each of said holding members having a plurality of intersecting sides such that each of said holding members has a cuboid shape wherein each of said holding members is configured to have the ornamental appearance of a mineralized crystal, said lower end of each of said holding members being coupled to a respective one of said intersecting sides of said outer surface of said respective support member at a point located adjacent to said top end of said respective holding member such that each of said sets of said holding members radiates outwardly from said top end of said respective support member, each of said intersecting sides of said outside surface of each of said holding members tapering to a point at said upper end of said holding members.

* * * * *